United States Patent [19]

Palmer

[11] Patent Number: 4,599,934

[45] Date of Patent: Jul. 15, 1986

[54] GAS OPERATED FIREARM

[76] Inventor: Larry A. Palmer, 1554 Duffus Dr., Howland Township, Trubull County, Warren, Ohio 44484

[21] Appl. No.: 631,987

[22] Filed: Jul. 18, 1984

[51] Int. Cl.[4] ..... F41D 5/08

[52] U.S. Cl. ..... 89/193; 42/97

[58] Field of Search ..... 89/128, 191.02, 193; 42/1 W

[56] References Cited

U.S. PATENT DOCUMENTS 2,256,569 10/1941 King ..... 42/1 W 3,443,477 5/1969 Kaempf ..... 89/193

OTHER PUBLICATIONS

Webster's New World Dictionary of the American Language, College Edition, 1957, p. 1114.

*Primary Examiner*—Stephen C. Bentley

*Attorney, Agent, or Firm*—Harpman & Harpman

[57] ABSTRACT

This invention relates to firearms, such as shotguns, which utilize gas pressure developed by the explosion in the barrel to automatically eject the spent cartridge case or shell. A structure is provided for venting the expanding gases developed by the explosion so that the automatic shell ejection mechanism will not function.

5 Claims, 4 Drawing Figures

GAS OPERATED FIREARM

BACKGROUND OF THE INVENTION

1. Technical Field

This invention relates to firearms which utilize gas pressure developed by the explosion in the barrel to automatically eject the spent cartridge case or shell and a structure to selectively permit manual ejection of the empty shells by disabling the gas operated automatic ejection mechanism.

2. Description of the Prior Art

Prior art structures have employed devices for bleeding off the explosion gas through ports in the magazine tube of the firearm to the atmosphere before the gas can operate to actuate the automatic ejection mechanism. See for example U.S. Pat. No. 3,443,477.

The present invention greatly simplifies the apparatus heretofore proposed as in the above patent.

SUMMARY OF THE INVENTION

A magazine tube secured to the barrel of a firearm, such as a shotgun, receives a fixed cylindrical body having passageways therethrough, axially and transversely. A rod is slidably positioned in the axial bore of the cylindrical body and extends outwardly therefrom and has an enlarged end acting as a shell follower. The rod controls communication between the transverse passageways and the axial passageway of the cylindrical body so that successive firing of two shells in the gun will result in the first shell being ejected and the second shell held in the chamber.

DESCRIPTION OF THE PREFERRED EMBODIMENT

Figure 1:
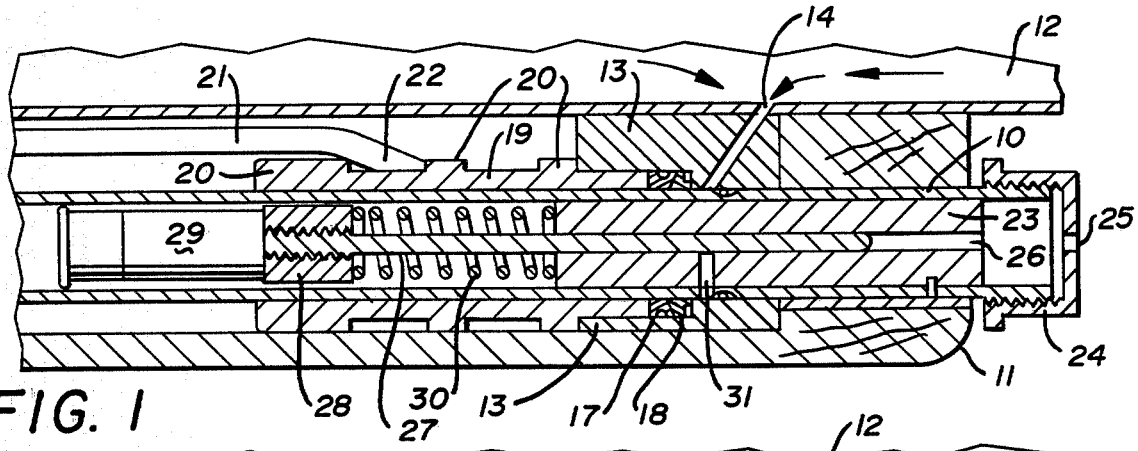
FIG. 1 is an enlarged vertical section through a portion of the gas operated firearm showing the device of the invention in a first position.
Figure 2:
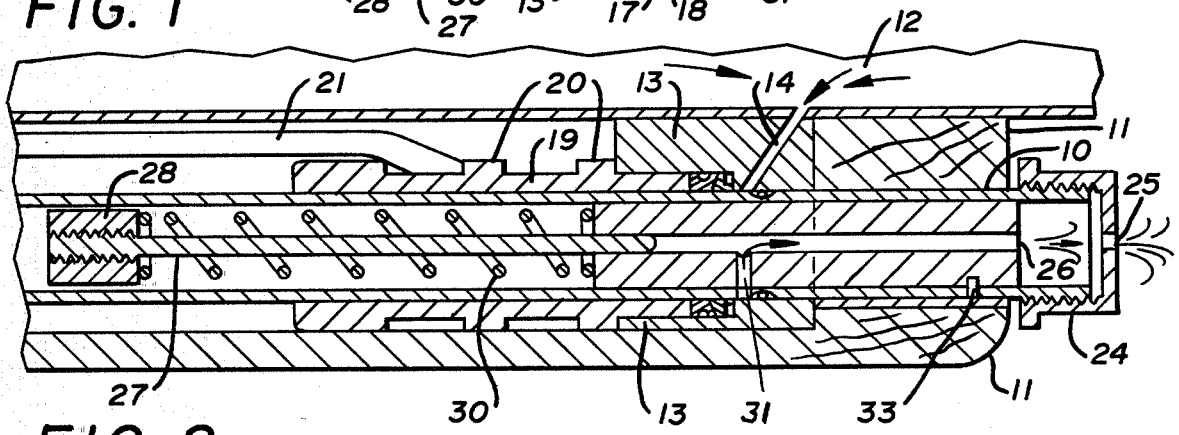
FIG. 2 is a view similar to FIG. 1 showing the device of the invention in second position.
Figure 3:
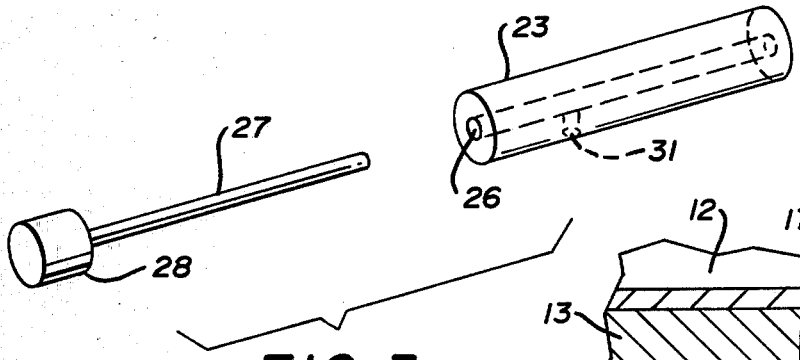
FIG. 3 is an exploded view showing the dual valve formed by the cylindrical body and rod slidable axially therein.

By referring to the drawings and FIGS. 1 and 2 in particular, the gas operated firearm and specifically the improvement therein will be seen to include a magazine tube 10 enclosed by the wooden fore-grip 11 of a shotgun having a barrel 12. A gas cylinder 13 surrounds the magazine tube 10 and is provided with a diagonal gas passageway 14 communicating at one end with the interior of the barrel 12 of the shotgun and at its other end with the inner surface of the gas cylinder 13 and adjacent the exterior surface of the magazine tube 10 and an annular groove 15 therein. An O-ring 16 is disposed in the annular groove 15 and forms a first seal. A double sealing arrangement comprising an adjacent pair of annular members 17 and 18 are also positioned around the exterior of the magazine tube 10 and in an area of increased diameter in the gas cylinder 13. A sleeve 19 having annular ribs 20 thereon in spaced relation to one another is slidably mounted on the exterior of the magazine tube 10 with one end thereof engaging the area of reduced diameter in the gas cylinder 13 and abutting the double sealing members 17 and 18 heretofore referred to.

An action bar 21 having an angularly disposed lower end 22 is positioned longitudinally of the device and has the angular lower end 22 thereof engaged against one of the annular ribs 20 on the sleeve 19. An cylindrical body 23 is positioned on the magazine tube 10 inwardly of a cap 24 positioned on the outer, right end, thereof. The cap 24 is apertured as at 25 and the cylindrical body 23 has an axial bore 26 therethrough and a valve rod 27 is slidably positioned therein and extends out of the left end of the cylindrical body 23. A shell follower 28 is secured to the outer end of the valve rod 27 and as illustrated in FIG. 1 of the drawings, a shell or cartridge case 29 is seen in the magazine tube 10 adjacent the shell follower 28. A coil spring 30 is positioned between the opposed ends of the cylindrical body 23 and the shell follower 28 and normally urges the shell follower 28 and the valve rod 27 away from the cylindrical body 23.

When there is a shell or cartridge in the firing chamber of the gun, not shown, and one in the magazine tube 10 as shown at 29 in FIG. 1 of the drawings, the valve rod 27 is so positioned in the bore 26 of the cylindrical body 23 to close a transverse passageway 31 therein.

Figure 4:
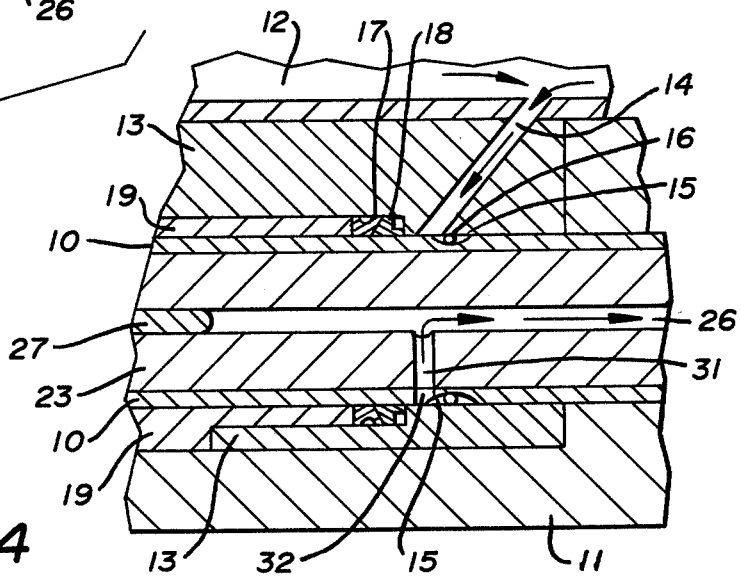
FIG. 4 is an enlarged detail of a portion of FIG. 2 of the drawings illustrating an annular passageway formed in the outer surface of the magazine tube.

As best seen in FIG. 4 of the drawings, the transverse passageway 31 in the cylindrical body 23 registers with an opening 32 in the magazine tube 10 which in turn communicates in limited degree with the annular groove 15 in the exterior thereof.

By referring to FIGS. 2 and 4 of the drawings in particular, it will be seen that when the valve rod 27 is in extended position, moved to the left as shown, by the coil spring 30, explosive gas in the barrel 12 of the firearm will flow downwardly through the passageway 14 in the gas cylinder 13 and communicate with the annular groove 15 in the exterior of the magazine tube 10. It will then flow around the magazine tube 10 and into the opening 32 therein and into the transverse passageway 31 and into the axial bore 26 where it will then flow therethrough into the cap 24 and out to atmosphere through the opening 25 therein as illustrated by the arrows in FIG. 2 of the drawings.

Thus the valve rod 27 acts to vent the explosive gas from the firearm and prevents the actuation of the ejection mechanism, not shown, whenever there is no shell or cartridge casing in the magazine tube.

Those skilled in the art of skeet or trap shooting will observe that the very simple mechanism disclosed herein can be easily formed of inexpensive materials and quickly and easily installed in a firearm having a gas operated ejection mechanism. It will be obvious that when using the firearm in shooting skeet or trap and manual ejection of the shells is desired, the mechanism permits the shooter to control the ejection of the spent shells which is desirable as generally trap and skeet shooting rules require that the shooter retain the empty shells rather than permit them to be automatically ejected to the ground. Furthermore, it is desirable for the trap and skeet shooter to retain the empty shells for the purpose of reloading.

It will thus be seen that by using the mechanism of the present invention, a shooter shooting doubles with one shell in the magazine and one in the chamber, controls the ejection mechanism through the use of the present device, as with the first shot of the doubles, the explosion gases are directed by the passageway 14 through the gas cylinder 13 and against the sleeve 19 so as to operate the action of the gun to automatically eject the spent shell which the shooter then retains. With the ejection of the spent shell, the mechanism moves to the position illustrated in FIGS. 2 and 4 of the drawings and heretofore described, wherein the explosion gases from the second shot will be vented through the described passageways which renders the automatic ejection mechanism inoperative for the second shot.

Those skilled in the art will also observe that the ejection mechanism is rendered inoperative when shooting singles so that the spent shell can be manually removed by the shooter and retained for the purposes of reloading.

It will thus be seen that a novel, extremely simple device for controlling the automatic shell ejection mechanism in a gas operated firearm has been disclosed and it will further occur to those skilled in the art that by forming the cylindrical body 23 of different materials having varying weights, the weight and/or balance of the firearm may be controlled so that the particular weight and balance of the firearm with which the shooter is experienced can be maintained as for example forming the cylindrical body 23 of a weighted plastic material or a light plastic material and/or forming the same of different metals or different weights. The cylindrical body 23 regardless of the material it is formed from or the weight of the same will be of substantially the same configuration with the same longitudinal and transverse passageways and as customary in the art will be secured in the magazine tube of the firearm by the usual roll pin as indicated by the reference numeral 33 in the drawings.

Having thus described my invention, what I claim is:

1. In a firearm in which the explosition gases act to automatically eject empty shells and including a barrel and a magazine tube, a gas cylinder communicating with the barrel and a sleeve movable along said magazine tube and connected to an ejection mechanism, the improvement comprising the magazine tube having an opening therein and a passageway therearound communicating with said opening; a cylindrical body positioned in said magazine tube having an axial bore and a transverse passageway communicating with said axial bore and with said opening in said magazine tube; an elongated valve rod slidably disposed in said axial bore and extending outwardly therefrom, a shell follower on the outermost end of said valve rod and spring means between said shell follower and said cylindrical body urging said valve rod outwardly of said axial bore, said valve rod movable from a first position outwardly of said cylindrical body to a second position inwardly of said cylindrical body in closing relation to said transverse passageway therein, an apertured closure on an end of said magazine tube whereby explosive gases in said firearm can be vented to atmosphere when said valve rod is in said first position and said explosion gases can move said sleeve and activate said shell ejection mechanism of said firearm when said valve rod is in said second position.

2. The structure of claim 1 and including sealing means between said gas cylinder and said magazine tube arranged to block said explosion gases whereby said sleeve is movable coaxially of said magazine tube when said valve rod is in said second position.

3. The structure of claim 1 wherein said sleeve has annular grooves and ridges arranged alternately on its exterior surface and slidably positioned on said magazine tube and movably engaging said gas cylinder and sealing means positioned in said cylindrical body between a portion thereof and said sleeve for blocking the passageway of explosion gases whereby said sleeve will move relative to said magazine tube responsive to said explosion gases when said valve rod is in said first position.

4. The structure of claim 1 wherein said sleeve is of a dimension enabling it to be slidably mounted on said magazine tube and a diagonally positioned passageway in said gas cylinder body extends between said magazine tube and a port in said barrel of said firearm.

5. The structure of claim 1 wherein said cylindrical body is formed of materials having known different weights to enable the balance of a firearm to be alternated by selecting said cylindrical body of desired weight for incorporation in said gas operated firearm.

* * * * *